United States Patent [19]

Kolleth et al.

[11] Patent Number: 4,778,221

[45] Date of Patent: Oct. 18, 1988

[54] MOVABLE DEVICE FOR OPENPIT MINING

[75] Inventors: Horst Kolleth; Franz Menapace; Herwig Wrulich, all of Zeltweg; Hubert Weissensteiner, Knittelfeld, all of Austria

[73] Assignee: Voest-Alpine Aktiengesellschaft, Linz, Austria

[21] Appl. No.: 55,882

[22] Filed: Jun. 1, 1987

[30] Foreign Application Priority Data

Jun. 6, 1986 [AT] Austria ..... 1545/86

[51] Int. Cl.[4] ..... E21C 3/20; E21C 27/28

[52] U.S. Cl. ..... 299/70; 299/94

[58] Field of Search ..... 299/69, 70, 48, 52, 299/54, 61, 62, 73, 74, 94

[56] References Cited

U.S. PATENT DOCUMENTS

| | | | |
|---|---|---|---|
| 1,475,311 | 11/1923 | Miller | 408/229 |
| 1,866,753 | 7/1932 | Comoletti | 299/70 X |
| 3,999,805 | 12/1976 | Lockwood | 299/66 |
| 4,025,116 | 5/1977 | Roepke et al. | 299/17 |
| 4,243,107 | 1/1981 | Shook | 299/70 X |
| 4,664,449 | 5/1987 | Barnthaler et al. | 299/74 |

FOREIGN PATENT DOCUMENTS

| | | | |
|---|---|---|---|
| 2315833 | 10/1974 | Fed. Rep. of Germany | 299/70 |
| 3513821 | 10/1986 | Fed. Rep. of Germany | 299/94 |
| 424974 | 9/1974 | U.S.S.R. | 299/73 |
| 0883428 | 11/1981 | U.S.S.R. | 299/94 |

*Primary Examiner*—Stephen J. Novosad
*Assistant Examiner*—David J. Bagnell
*Attorney, Agent, or Firm*—Cushman, Darby & Cushman

[57] ABSTRACT

A movable device (1) for openpit mining has a plurality of excavating hammers (11) on a cantilever boom (2) being swivellable in height direction. For facilitating the continuous excavating work and for providing an adaptability to the varying angles of inclination encountered in openpit mining, at least part (23) of the carrier (6) or the carrier (6) itself is shiftable in transverse relation to the longitudinal axis (7) of the cantilever arm (2), so that on downward swivelling movement of the cantilever arm (2) in direction of the arrow (17) the whole carrier (6) or at least part (23) thereof can be shifted in transverse relation to the longidudinal axis (7) of the cantilever arm by a hydraulic cylinder-piston-aggregate (8), thereby maintaining a predetermined angle of inclination or angle of repose.

9 Claims, 4 Drawing Sheets

FIG. 3
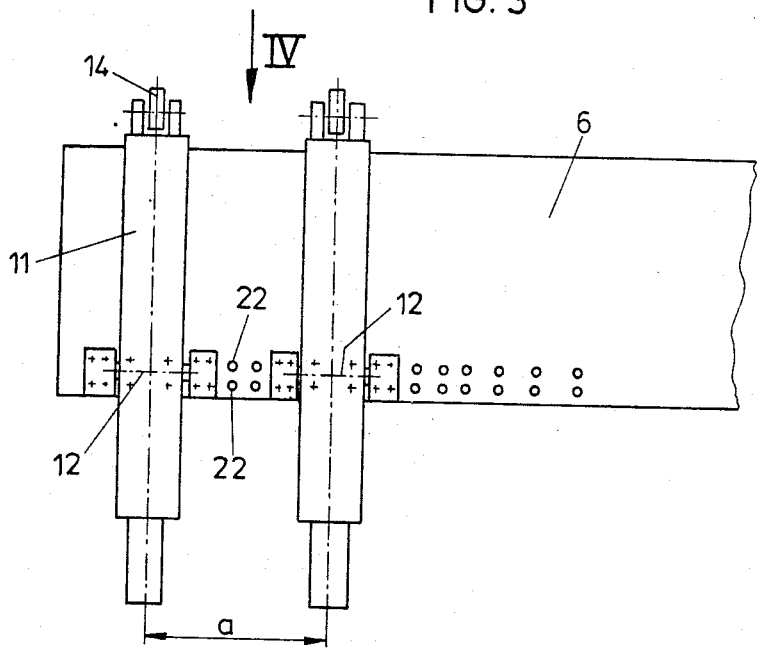
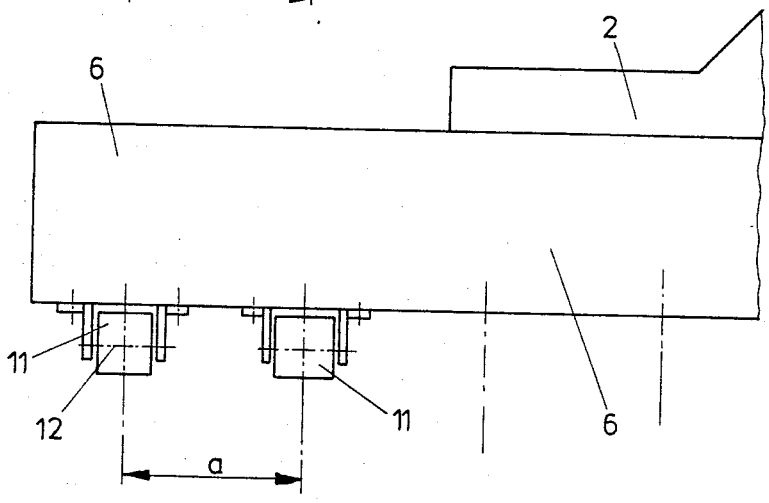
FIG. 4

MOVABLE DEVICE FOR OPENPIT MINING

BACKGROUND OF THE INVENTION

1. Field of the Invention

The invention refers to a movable device for openpit mining serving the purpose of excavating ground and/or rock, in particular ores, comprising a swivellable cantilever arm on which is mounted a hulking hammer.

2. Description of the Prior Art

In openpit mining there are primarily used big broaching vehicles, such as bucketwheel excavators, for excavating material. Such known devices of the mentioned type can, however, only be used for excavating rock having a cubic strength of approximately 20 MPa and can not be used for excavating in openpit mining rock or ore of greater hardness without precautions. When excavating harder rock, excavation must, as a rule, be interrupted for making bore holes and/or applying explosive charges for being then in the position to obtain correspondingly crushed material.

It is already known to mount on a cantilever arm a fluid-operated hammer and to loosen and to take up with such devices the surface layer of roads when performing, for example, construction work and repairing work, whereupon the thus crushed material can be transported away in a usual manner.

From U.S. Pat. No. 3,999,805 there has become known a kinkable support for a loosening tool, for example an excavating hammer or a loading shovel. The U.S. Pat. No. 4,025,116 shows and describes an excavating device by means of which a carrier comprising excavating spikes is forced under hydraulic pressure into the rock to be excavated, whereupon the rock is crushed by hydraulically lowering or lifting, respectively, the carrier.

SUMMARY OF THE INVENTION

The invention now aims at providing a device for open-pit mining of the initially mentioned type, by means of which it is possible to effect continuous excavation also in case of rock or ore of higher cubic strength. It is in particular intended to provide a device for openpit mining of the initially mentioned type which can be travelled and be adapted to the geological situation in a manner that the continuity of operation is made sure without any interruptions. For solving this task, the device for openpit mining according to the invention essentially consists in that the cantilever arm has at its free end a carrier extending in transverse relation to the longitudinal axis of the cantilever arm and carrying a plurality of excavating hammers, in that at least part of the carrier is guided for being shiftable in transverse direction relative to the longitudinal axis of the cantilever arm and in that a shifting drive means for the carrier or part of the carrier, respectively, is provided. On account of a plurality of excavating hammers being arranged on a carrier transversely extending relative to a cantilever arm there is obtained a high excavating capacity, and on account of at least part of the carrier being shiftable in transverse direction relative to the longitudinal axis of the cantilever arm there can be achieved in continuous operation an adaptation to angles of repose corresponding to the nature of the land or the material to be excavated, respectively, so that the device for openpit mining is given a continuous movability and an excavation capacity is obtained in a reliable manner. In correspondence with the desired angle of repose, the carrier is, with progressing depth of excavation, shifted in transverse relation relative to the longitudinal axis of the cantilever arm, for which purpose is provided a shifting drive means for the carrier or for the part of the carrier, respectively.

In this case and in a particularly advantageous manner, the shifting drive means is fomred of a cylinder-piston-aggregate acting on the cantilever arm and on the carrier and extending in transverse relation to the longitudinal axis of the cantilever arm. In this manner, there is provided a constructively particularly simple solution of the problem, noting that hydraulic fluids or pressurized air are primarily contemplated for actuating the carrier as well as the excavating hammers.

The guide means for shifting the carrier in transverse relation to the cantilever arm can, in a simple manner, be designed such that the cantilever arm has at its free end a crosshead which is partially embraced by the carrier, noting that the carrier embraces the crosshead, as seen in a side-view, according to a C-shape. In this manner, a reliable guiding effect is obtained in shifting direction of the carrier and simultaneously a reliable mounting of the carrier on the cantilever arm is obtained, so that there is avoided any tilting of the carrier in transverse relation to the longitudinal axis of the cantilever arm.

For mounting a plurality of excavating hammers on the carrier, the carrier is advantageously provided with a plurality of locations of attack, in particular bores, for fixing excavating hammers in position. That side of the carrier which is located remote from the cantilever arm can, in this case, in a simple manner be designed as a perforated plate, noting that it is of advantage to mount 10 to 40 excavating hammers one beside the other.

In consideration of the fact that on swivelling the cantilever arm the relative inclination of the peaks of the excavating hammers to the material to be excavated is changed, the mounting means for the excavating hammers is advantageously designed such that the excavating hammers are arranged on the carrier for being swivellable around an axis extending in transverse relation to the cantilever arm and for being lockable in their swivelled position. For obtaining particularly high excavating efficiencies per hour, it is necessary to select a particularly favourable angle under which the excavating hammers act on the rock to be excavated, and such a swivellable mounting provides the possibility to adjust said angle in dependence on the swivelled position of the cantilever arm. Adjustment of the inclination of the axes of the excavating hammers can, in this case, advantageously be achieved by supporting the excavating hammers on the carrier via an adjusting member, such as a worm drive or a hydraulic cylinder-piston-aggregate for example, acting on the excavating hammers at an off-center location relative to the swivelling axis.

When moving such a device for openpit mining to an other site, a certain angle of repose must be maintained at the side of the slope and with progressing depth of penetration of the excavating hammers, for which purpose the carrier is, as a whole, designed for being shiftable in its longitudinal direction. In addition, the arrangement can be such that the carrier is subdivided in longitudinal direction into at least two parts and that these parts of the carrier are supported for being shiftable one relative to the other in transverse relation to he longitudinal axis of the cantilever arm, noting that lateral portions of the carrier are preferably guided for being insertable in a telescoping manner into the middle part of the carrier. In this manner, there can be obtained a still further adaptation of the excavating work within the mining face facing the slope, and this without any loss of efficiency.

The excavating hammers can in a simple manner be formed of fluid-operated hammers.

For the continuous operation of the excavating device there is required, beside a corresponding movability of the device, a corresponding continuous removal of the excavated material. For this purpose and according to the invention, the arrangement is preferably such, that a loading ramp or loading chute is connected with the openpit mining device and extends over the major part of the length of the carrier, as measured transversely relative to the cantilever arm, and comprises removal conveyor means, in particular conveyor belts.

Excavating work can be improved if the openpit mining device has a certain amount of nose heavyness at the area of the excavating hammers for increasing in this manner the pressure exerted by the excavating hammers on the rock to be excavated. For this purpose, the arrangement is preferably such, that the carrier carries, in addition to the excavating hammers, auxiliary equipments such as hydraulic pumps and appliances for the energy supply of the openpit mining device, for example.

The cantilever arm can in a reliable and in a simple manner be given its swivellability by linking the cantilever arm to the frame of the openpit mining device for being swivellable around a substantially hoizontal axis and for being liftable and lowerable by means of a lifting cylinder. For improving the adaptability to existing geological formations the arrangement can advantageously and in addition be such that the cantilever arm is swivellably mounted on a rotating support being swivellable around a substantially vertical axis.

BRIEF DESCRIPTION OF THE DRAWING

In the following, the invention is explained in greater detail with reference to embodiments shown in the drawing.

In the drawing

FIG. 3 shows a view of a part of the carrier in the sense of the arrow III of FIG. 1, FIG. 4 shows a top-plan view in direction of the arrow IV of FIG. 3.

DETAILED DESCRIPTION OF THE PREFERRED EMBODIMENTS

Figure 1:
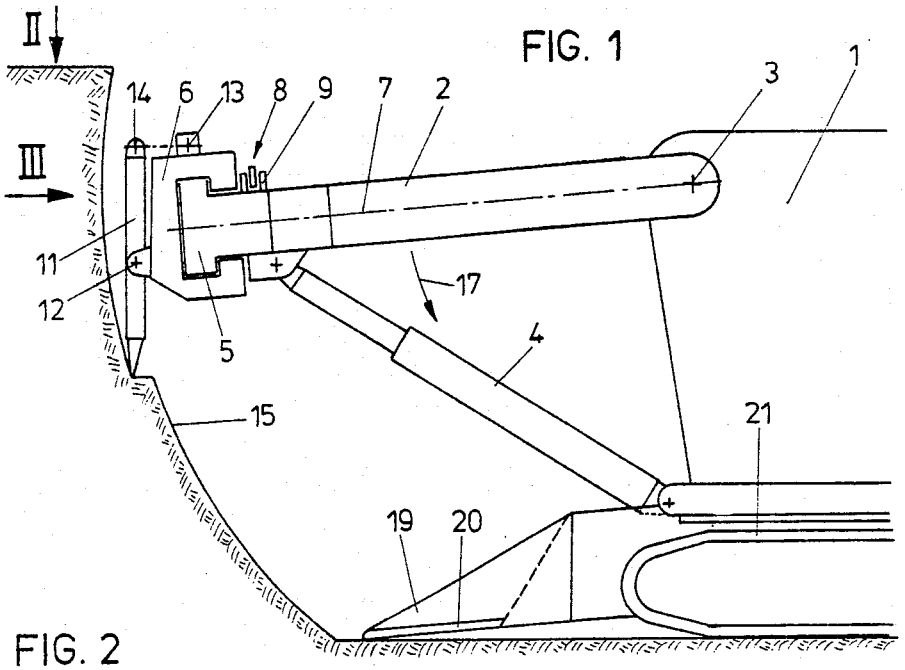
FIG. 1 shows a schematical side elevation of the front end of an openpit mining device according to the invention.

In FIG. 1, there can be seen the front end of an openpit mining device 1 to which is linked a cantilever arm 2 for being swivellable in height direction. Swivelling of this cantilever arm 2 around the substantially horizontal swivelling axis 3 is effected by means of a hydraulic cylinder-piston-aggregate 4. The free end of the cantilever arm 2 has a head-shaped enlargement 5, which is, as seen in a side elevation, designed as a T-profile. This free end 5 of the cantilever arm 2 is embraced by a carrier 6 having, as seen in a side elevation, a C-shaped inner profile. In this manner, the carrier 6 is thus guided for being siftable in essentially parallel relation to the swivelling axis 3 of the cantilever arm 2 and in transverse relation to the longitudinal axis 7 of the cantilever arm 2. The shifting drive means is formed of the hydraulic cylinder-piston-aggregate 8, which can more clearly be taken from FIG. 2. This hydraulic cylinder-piston-aggregate 8 is linked to the cantilever arm 2 within bearing eyes 9 and acts, as can be taken from FIG. 2, on the carrier 6 via a further bearing eye 10.

The front side of the carrier, which front side is located remote from the cantilever arm 2, carries excavating hammers 11 which are linked for being swivellable around a swivelling axis 12, noting that the inclination of the excavating hammers 11 can be changed by a worm drive 13. This worm drive 13 acts on the free upper end 14 of the excavating hammers.

Figure 2:
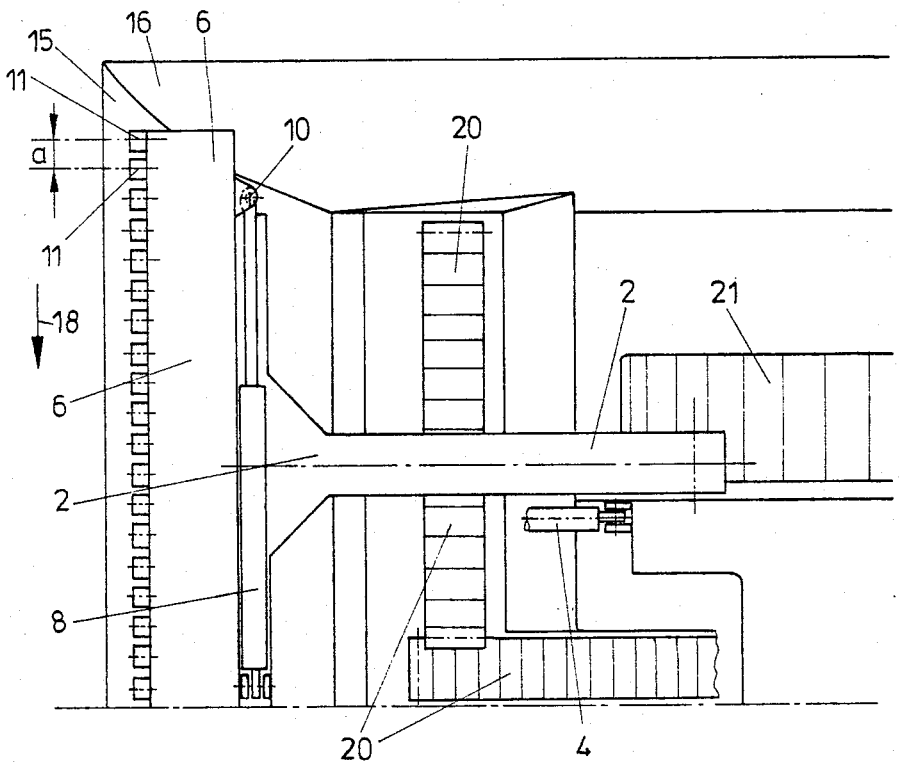
FIG. 2 shows a top-plan view in the sense of the arrow II of that half of the openpit mining device according to FIG. 1 which is facing the slope.

Reference numeral 15 designates the mine face, which passes over into the land via a slope 16, as can be taken from FIG. 2 and is usual in openpit mining at one side of the machine. As can in particular be taken from FIG. 2, a plurality of excavating hammers is arranged at distances a at the front side of the carrier 6. When swivelling the cantilever arm 2 in direction of the arrow 17, i.e. in downward direction, there would, as can more clearly be derived from the representation according to FIG. 2, result a collision of the lateral area of the carrier 6 with the slope 16, which collision can, however, be avoided by shifting the carrier 6 in direction of the arrow 18 of FIG. 2 by the hydraulic drive means 8.

The front end of the openpit mining device 1 has a bunker 19 for bulk material, said bunker having, as can be taken from FIG. 2, arranged within its interior conveyor means formed of conveyor belts 20. The material received by the bunker for bulk material is thus continuously removed via lateral conveyor belts 20 to the second conveyor belt 20 arranged approximately in the central area of the openpit mining device and can thus continuously be removed. The caterpillars of the caterpillar chassis of the openpit mining device are designated by 21.

As can be taken from FIGS. 3 and 4, a plurality of bores 22 is provided at the front side of the carrier 6, which allow to adjust the lateral distance (a) of adjacent excavating hammers 11 by selecting suitable bores for mounting in position the flanges for the swivelling axes (12). A worm drive or, respectively, a hydraulic cylinder-piston-aggregate for swivelling the excavating hammers 11 acts again on the free end 14 of the excavating hammers 11. The front end of the carriers 6 is thus designed as a perforated plate comprising the bores 22, so that the excavating hammers 11 can fixedly be mounted in different predetermined distances a.

Figure 5:
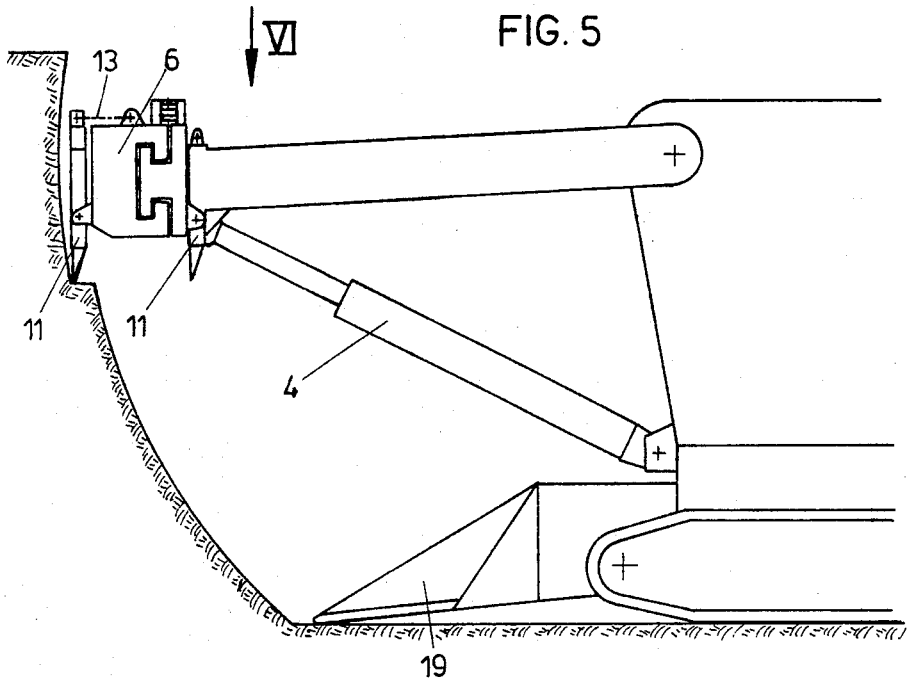
FIG. 5 shows a modified embodiment in an representation being analogous to that of FIG. 1.
Figure 6:
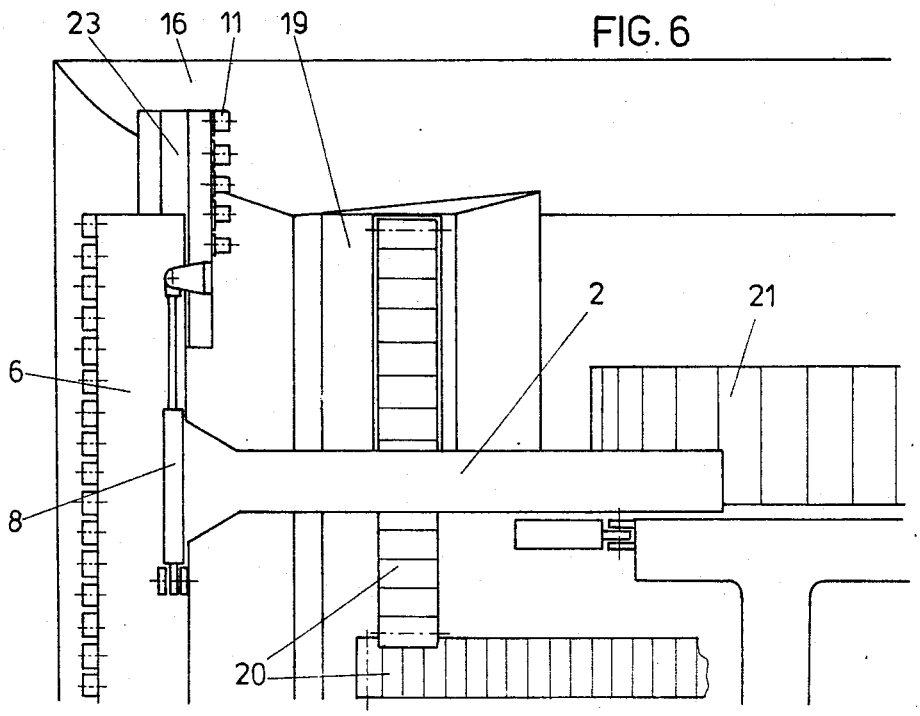
FIG. 6 shows a top-plan view of the representation according to FIG. 5 in direction of the arrow VI of FIG. 5.

In the representation according to FIGS. 5 and 6 the arrangement is such that not the whole carrier 6 is shiftable but only a lateral cantilevering part 23 of the carrier 6 is shiftable in a telescoping manner relative to the remaining part of the carrier 6. The cylinder-piston-aggregate 8 is, in this case, fixed to the carrier 6 and shifts the lateral cantilevering part 23 relative to the carrier 6 for obtaining in this manner an adaptation to the slope 16. In all other respects, the openpit mining device according to FIGS. 5 and 6 is designed in an analogous manner to the embodiment according to FIGS. 1 and 2. In this case, the carrier 6 can be integral with the cantilever arm 2 or rigidly be fixed to the cantilever arm 2.

Figure 7:
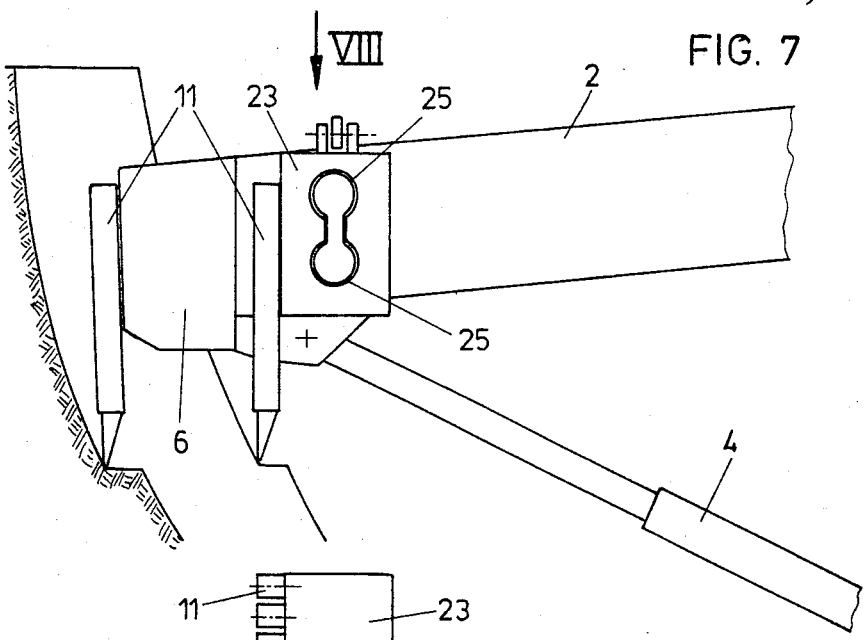
FIG. 7 shows a modified embodiment of an insertable carrier part in a represenation being analogous to that of FIG. 1
Figure 8:
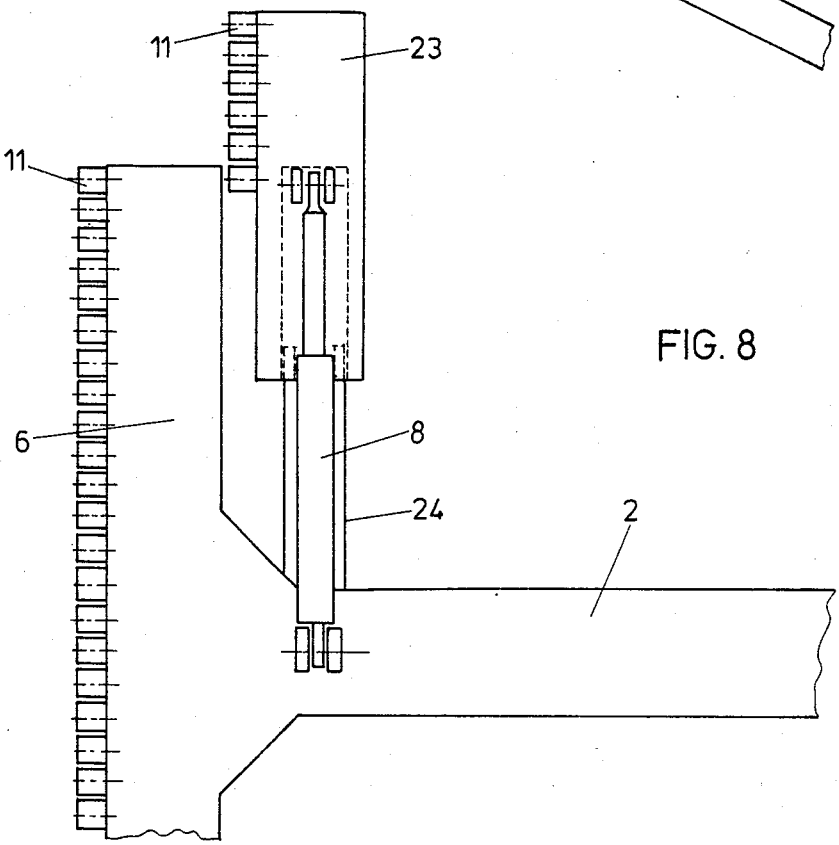
FIG. 8 shows a top plan view in direction of the arrow VIII of FIG. 7 of that half of the openpit mining device which is facing the slope.

In FIGS. 7 and 8 there can be seen modified embodiments of the guide means for the lateral carrier part 23 being insertable in a telescopic manner. In this embodiment, the guide means is formed of tubes 24. In this embodiment, the carrier 6 can rigidly be connected with the cantilever arm 2 and the carrier part 23 being shiftable in a telescopic manner has, as is shown in FIG. 7, bores 25 into which can be inserted the guide means formed by the tube 24. The hydraulic cylinder-piston-aggregate 8 serving the purpose of shifting the carrier part 23 being insertable in a telescopic manner may, in this case, concentrically be arranged relative to the tubular guide means. As an alternative, one of said both bores 25 may, however, accommodate the shifting drive means and the second of said bores may be guided by the tube 24. With all other respects, the construction of the openpit mining device according to FIGS. 7 and 8 again corresponds to the constructions according to FIGS. 1 and 2 and, respectively, according to FIGS. 5 and 6.

The essentially horizontally extending swivelling axis 3 for the cantilever arm 2 can, as is not shown in greater detail, be provided on a turntable being itself swivellable around a substantially vertical axis. For increasing the weight and thus for improving the excavating work, auxiliary equipments, such as, for example, components of the energy supply, may be arranged on the carrier 6 or, respectively, on the front end of the cantilever arm 2, so that the openpit mining device may have a certain amount of nose heavyness.

What is claimed is:

1. A movable device for excavating ground and rock in openpit mining, comprising:

a frame adapted to be supported on a generally horizontal mine surface;

an elongated cantilever arm having a rear end pivotally secured to said frame so as to provide for swiveling movement of said arm about a generally horizontal, transversally-extending axis; said arm further having a free foward end;

a transversally, generally horizontal-extending carrier;

means mounting said carrier to said forward end of said arm; and hulking hammer means comprising a plurality of generally vertically downwardly directed excavating hammers mounted to said carrier in a series extending along said carrier transversally of said arm;

said mounting means including a transversally extending crosshead mounted to the forward end of said arm, and a portion of said carrier at least partially surrounding and being supported on said crosshead;

said mounting means including means for shiftably mounting at least part of said carrier portion to said crosshead for transverse extension and retraction; and transversally-extending piston and cylinder drive means acting between said arm and said carrier for transversally shifting said shiftable at least part of said carrier; and said excavating hammers are mounted to said carrier by bracket means; said bracket means being mounted to said carrier by means permitting lateral adjustment of site of securement thereof to said carrier, whereby lateral placement of said excavating hammers may be adjusted; said bracket means including means pivotally mounting the respective said excavating hammers for limited pivotal movement about respective transverse, horizontally-extending axes; and means acting between said excavating hammers and said carrier for adjustably fixing attitudes of said excavating hammers about said respective transverse, horizontally-extending axes.

2. The movable device of claim 1, wherein:

said adjustable means for fixing the attitudes of said excavating hammers comprise fluid-operated piston-cylinder arrangements.

3. The movable device of claim 1, wherein:

said adjustable means for fixing the attitudes of said excavating hammers comprise worm drive means.

4. A movable device for excavating ground and rock in openpit mining, comprising:

a frame adapted to be supported on a generally horizontal mine surface;

an elongated cantilever arm having a rear end pivotally secured to said frame so as to provide for swiveling movement of said arm about a generally horizontal, transversally-extending axis; said arm further having a free forward end;

a transversally, generally horizontally-extending carrier;

means mounting said carrier to said forward end of said arm; and hulking hammer means comprising a plurality of generally vertically downwardly-directed excavating hammers mounted to said carrier in a series extending along said carrier transversally of said arm;

said carrier being divided into at least two parts;

said mounting means including means for shiftably mounting at least one said part of said carrier to said arm for transverse extension and retraction relative to another said part; and drive means for transversally shifting said one part of said carrier relative to said other part.

5. The movable device of claim 4, wherein:

said carrier is divided into at least three parts, including one medial part and two lateral parts; said mounting means includes means for shiftably mounting both said lateral parts of said carrier relative to said medial part for transversally extending and retracting said lateral parts relative to said medial part; said lateral parts being telescopically related to said medial part by said mounting means; and said drive means transversally shifting both lateral parts of said carrier relative to said medial part.

6. The movable device of claim 4, further including:

a loading ram extending widthwise of said device along a major part of the length of said carrier and arranged to receive material mined by operation of said excavating hammers; and a removal conveyor associated with said loading ramp for receiving mined material received by said loading ramp and for carrying away said mined material;

said loading ramp and removal conveyor being supported by said frame.

7. The movable device of claim 4, wherein:

said mounting means includes a transversally extending crosshead mounted to the forward end of said arm, and a portion of said carrier at least partially surrounding and being supported on said crosshead.

8. The movable device of claim 4, wherein:

said plurality of excavating hammers comprises 10–40 excavating hammers.

9. The movable device of claim 4, further including:

a fluid-operated piston-cylinder arrangement acting between said free forward end of said arm and said frame for swiveling said arm about said generally horizontal, transversally-extending axis of said rear end of said arm.

* * * * *